US007100326B2

(12) United States Patent
Shimada et al.

(10) Patent No.: US 7,100,326 B2
(45) Date of Patent: Sep. 5, 2006

(54) DRIVE DEVICE HAVING A CABLE ADJUSTING FEATURE FOR A SLIDING BODY

(75) Inventors: Junichi Shimada, Yokohama (JP); Shinichiro Kita, Yokohama (JP)

(73) Assignee: Ohi Seisakusho Co., Ltd., Kanagawa (JP)

( * ) Notice: Subject to any disclaimer, the term of this patent is extended or adjusted under 35 U.S.C. 154(b) by 137 days.

(21) Appl. No.: 10/434,148

(22) Filed: May 9, 2003

(65) Prior Publication Data

US 2004/0003542 A1 Jan. 8, 2004

(30) Foreign Application Priority Data

May 13, 2002 (JP) ..... 2002-137768

(51) Int. Cl.
*E05F 11/54* (2006.01)

(52) U.S. Cl. ..... 49/360; 49/352; 242/388.6

(58) Field of Classification Search ..... 49/352, 49/349, 348, 350, 360; 242/388.6, 388.8
See application file for complete search history.

(56) References Cited

U.S. PATENT DOCUMENTS 4,440,354 A * 4/1984 Kobayashi et al. ..... 242/388.8
4,577,439 A * 3/1986 Seki ..... 49/352
4,644,694 A * 2/1987 Ujihara ..... 49/352
4,840,080 A * 6/1989 Kobayashi et al. .... 74/501.5 R
5,319,880 A * 6/1994 Kuhlman ..... 49/360
5,564,231 A * 10/1996 Tajima et al. ..... 49/352
6,052,946 A * 4/2000 Isomura ..... 49/352
6,179,742 B1 * 1/2001 Haag et al. ..... 475/154
6,629,905 B1 * 10/2003 Sesselmann et al. ..... 475/149

FOREIGN PATENT DOCUMENTS

JP 11-91355 A 4/1999

* cited by examiner

*Primary Examiner*—Gregory J. Strimbu
(74) *Attorney, Agent, or Firm*—Sughrue Mion, PLLC

(57) ABSTRACT

A drive device for opening and closing a slide body includes: a drum mating with a secondary cable end portion of a first cable and a secondary cable end portion of a second cable. The drum includes; a main drum mating with the secondary cable end portion of one of the first cable and the second cable, and a sub-drum mating with the secondary cable end portion of the other of the first cable and the second cable. An inner gear is formed on an inner face of one of the main drum and the sub-drum. An outer gear is formed on an outer face of the other of the main drum and the sub-drum. The inner gear meshing with the outer gear for adjusting a cable length of the first cable and a cable length of the second cable.

9 Claims, 10 Drawing Sheets

DRIVE DEVICE HAVING A CABLE ADJUSTING FEATURE FOR A SLIDING BODY

BACKGROUND OF THE INVENTION

1. Field of the Invention

The present invention relates to a drive device for opening and closing a slide body, in accordance with a rotational direction of a drum, by winding in one of a first cable and a second cable {the first cable and the second cable connecting to the slide body} while winding out the other of the first cable and the second cable.

2. Description of the Related Art

Japanese Patent Unexamined Publication No. Heisei 11 (1999)-091355 (=JP11091355) discloses a drive device for a slide door of this type. The drive device according to Japanese Patent Unexamined Publication No. Heisei 11 (1999)-091355 (=JP11091355) has the following constitution:

A first cable and a second cable connecting to a slide door are in a state of winding around a main drum. Rotating the main drum in a first direction by winding in one of the first cable and the second cable while winding out the other of the first cable and the second cable can open the slide door. Contrary to this, rotating the main drum in a second direction opposite to the first direction by winding in the other of the first cable and the second cable while winding out the one of the first cable and the second cable can close the slide door.

Moreover, the drive device according to the Japanese Patent Unexamined Publication No. Heisei 11 (1999)-091355 (=JP11091355) is provided with an adjuster drum coupled with the main drum. In accordance with a coupling position for coupling the adjuster drum with the main drum, the first cable and the second cable are adjustable in length.

More specifically, one of the first cable and the second cable has a cable end portion mating with the main drum, while the other of the first cable and the second cable has a cable end portion mating with the adjuster drum. In accordance with the coupling position for coupling the adjuster drum with the main drum, the first cable and the second cable are adjustable in length.

Around a shaft, the adjuster drum is rotatable coaxially with the main drum. In a direction along the shaft, the main drum and the adjuster drum are opposed to each other. The main drum has ratchet teeth arranged circumferentially, while the adjuster drum has ratchet teeth arranged circumferentially. Setting the main drum is before setting the adjuster drum. Pushing the adjuster drum toward the pre-set main drum in the direction of the shaft can mesh the ratchet teeth of the adjuster drum with the ratchet teeth of the main drum. In accordance with a meshing position for meshing the ratchet teeth of the adjuster drum with the ratchet teeth of the main drum, in other words, in accordance with the coupling position for coupling the adjuster drum with the main drum, the first cable and the second cable are adjusted in length.

The thus obtained coupling state of the adjuster drum with the main drum can be kept by means of a spring for biasing the adjuster drum to the main drum.

For keeping the coupling state of the adjuster drum coupled with the main drum, however, the drive device according to the Japanese Patent Unexamined Publication No. Heisei 11 (1999)-091355 (=JP11091355) is expected to have the spring. Moreover, coupling portions where the ratchet teeth of the adjuster drum meshing with the ratchet teeth of the main drum formed on axially opposing faces of the main drum and the adjuster drum may hinder visual inspection in adjusting the coupling position, thus deteriorating workability in assembling the adjuster drum to the main drum.

BRIEF SUMMARY OF THE INVENTION

It is an object of the present invention to provide a drive device for a slide body.

It is another object of the present invention to provide simplified constitution of the drive device for secure coupling of an adjuster drum with a main drum.

It is still another object of the present invention to facilitate adjustment of a coupling position for coupling the adjuster drum with the main drum when adjusting a cable in length.

According to a first aspect of the present invention, there is provided a drive device for opening and closing a slide body.

The drive device comprises:

I) a first cable having a primary cable end portion connecting to the slide body and a secondary cable end portion opposite to the primary cable end portion of the first cable, the first cable having a cable length;

II) a second cable having a primary cable end portion connecting to the slide body and a secondary cable end portion opposite to the primary cable end portion of the second cable, the second cable having a cable length; and III) a drum mating with the secondary cable end portion of the first cable and mating with the secondary cable end portion of the second cable, the drum being adapted to rotate in a first rotational direction for winding in one of the first cable and the second cable while winding out the other of the first cable and the second cable, thus opening the slide body, the drum being adapted to rotate in a second rotational direction opposite to the first rotational direction for winding in the other of the first cable and the second cable while winding out the one of the first cable and the second cable, thus closing the slide body.

The drum comprises;

i) a main drum mating with the secondary cable end portion of the one of the first cable and the second cable so as to make the rotation, the main drum having an inner face and an outer face, and ii) a sub-drum mating with the secondary cable end portion of the other of the first cable and the second cable so as to make the rotation substantially coaxially with the main drum around a shaft, the sub-drum having an inner face and an outer face.

An inner gear is formed on the inner face of one of the main drum and the sub-drum. An outer gear is formed on the outer face of the other of the main drum and the sub-drum. The inner gear meshing with the outer gear defines a position for adjusting the cable length of the first cable and the cable length of the second cable.

According to a second aspect of the present invention, there is provided a slide body comprising:

I) a first cable having a primary cable end portion connecting to a slide door of the slide body and a secondary cable end portion opposite to the primary cable end portion of the first cable, the first cable having a cable length;

II) a second cable having a primary cable end portion connecting to the slide door of the slide body and a secondary cable end portion opposite to the primary cable end portion of the second cable, the second cable having a cable length; and III) a drive device for opening and closing the slide door of the slide body, comprising;

a drum mating with the secondary cable end portion of the first cable and mating with the secondary cable end portion of the second cable, the drum being adapted to rotate in a first rotational direction for winding in one of the first cable and the second cable while winding out the other of the first cable and the second cable, thus opening the slide door of the slide body, the drum being adapted to rotate in a second rotational direction opposite to the first rotational direction for winding in the other of the first cable and the second cable while winding out the one of the first cable and the second cable, thus closing the slide door of the slide body.

The drum comprises;

i) a main drum mating with the secondary cable end portion of the one of the first cable and the second cable so as to make the rotation, the main drum having an inner face and an outer face, and ii) a sub-drum mating with the secondary cable end portion of the other of the first cable and the second cable so as to make the rotation substantially coaxially with the main drum around a shaft, the sub-drum having an inner face and an outer face.

An inner gear is formed on the inner face of one of the main drum and the sub-drum. An outer gear is formed on the outer face of the other of the main drum and the sub-drum. The inner gear meshing with the outer gear defines a position for adjusting the cable length of the first cable and the cable length of the second cable.

The other objects and features of the present invention will become understood from the following description with reference to the accompanying drawings.

DETAILED DESCRIPTION OF THE EMBODIMENT

In the following, various embodiments of the present invention will be described in detail with reference to the accompanying drawings.

For ease of understanding, the following description will contain various directional terms, such as, left, right, upper, lower, forward, rearward and the like. However, such terms are to be understood with respect to only a drawing or drawings on which the corresponding part of element is illustrated.

Hereinafter described is a drive device 4 for a slide door 1 of a vehicle, according to an embodiment of the present invention.

Figure 1:
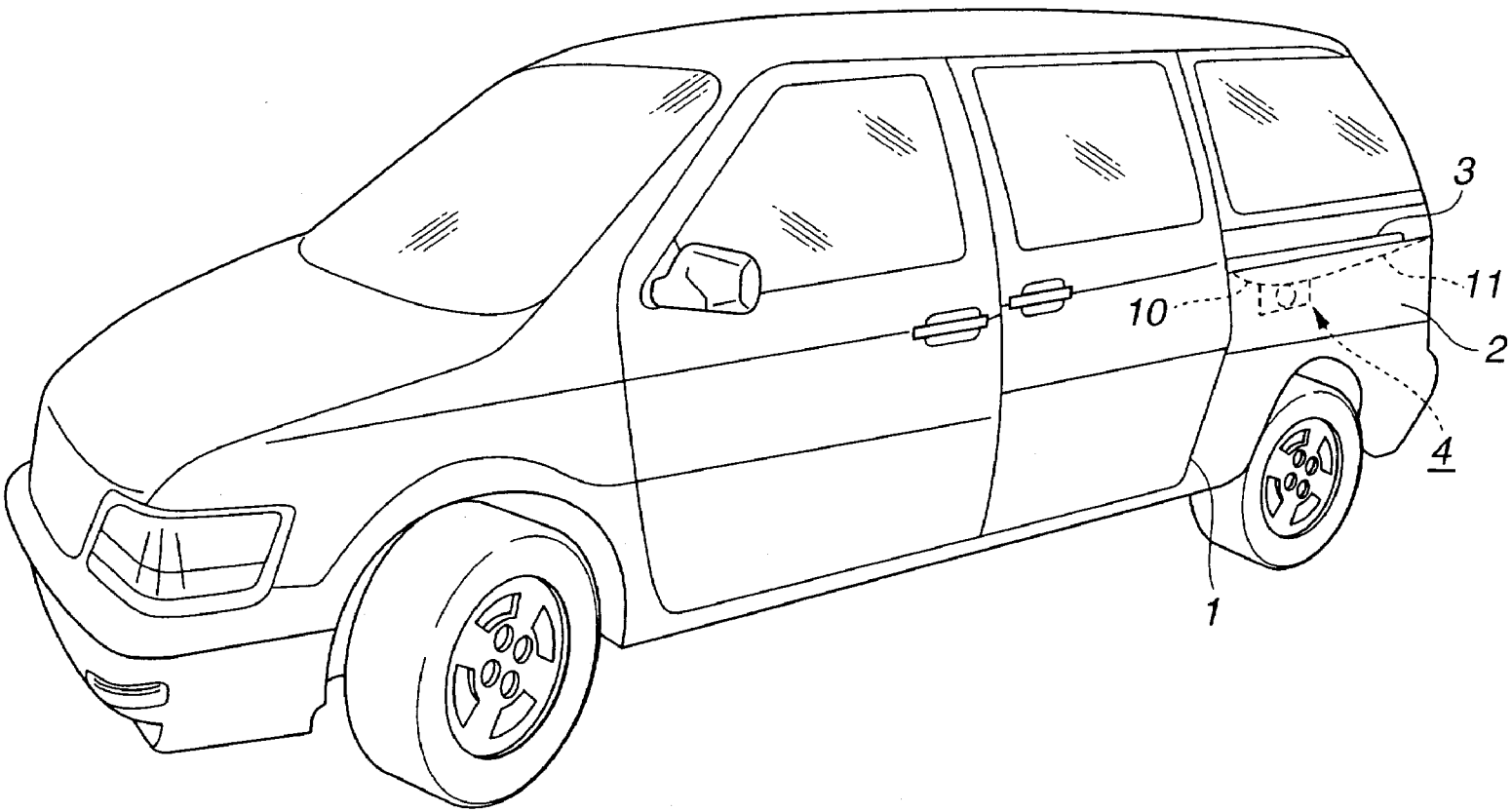
FIG. 1 is a perspective view of a vehicle equipped with a drive device 4, according to an embodiment of the present invention.

FIG. 1 shows a perspective view of the vehicle equipped with the slide door 1 (otherwise referred to as "slide body 1"). Sliding the slide door 1 backward along a guide rail 3 opens the slide door 1, while sliding the slide door 1 forward along the guide rail 3 closes the slide door 1. On a body 2's side, there is provided the drive device 4 for sliding the slide door 1 via a first cable 10 and a second cable 11.

Figure 2:
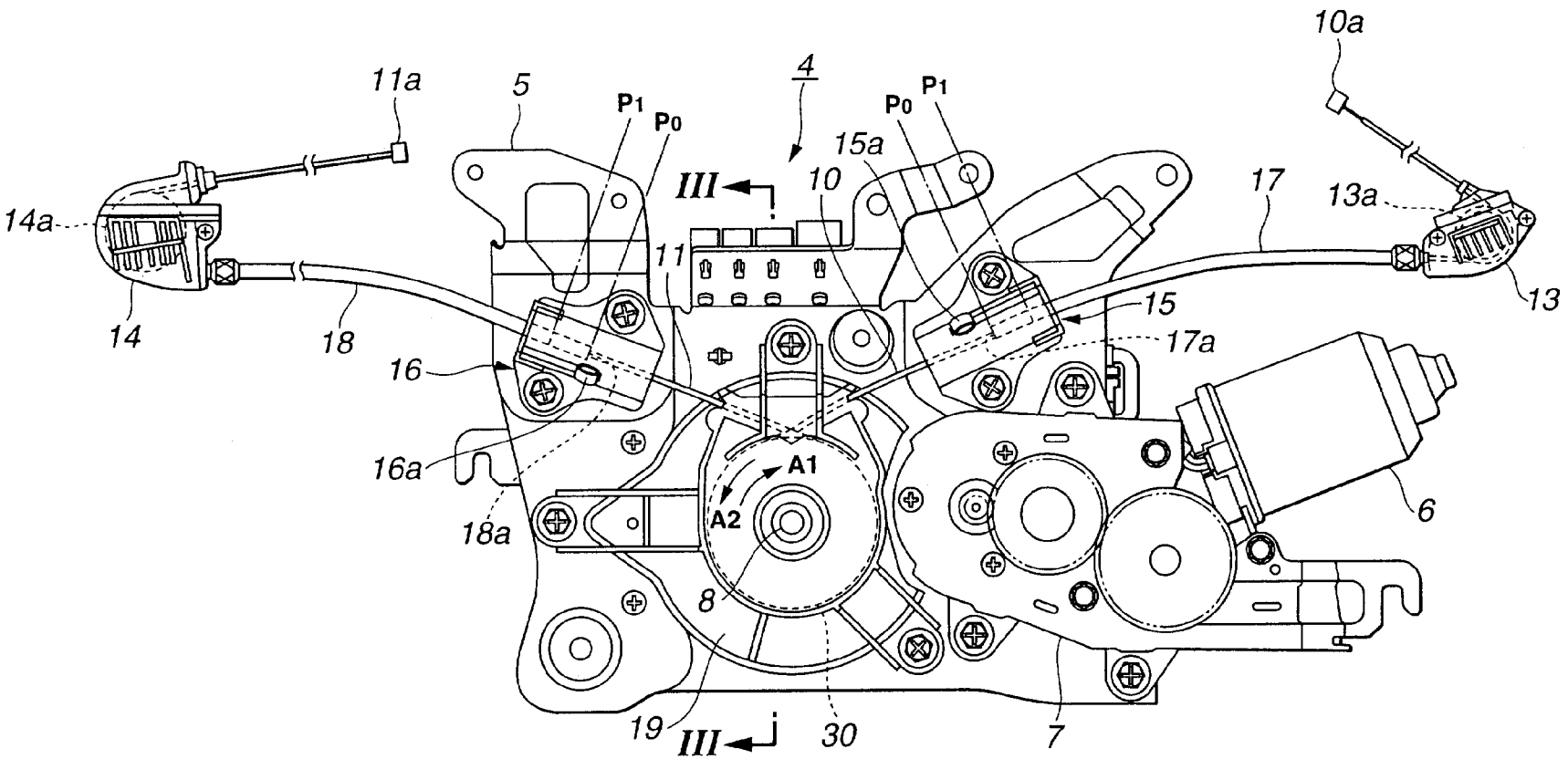
FIG. 2 is a front view of the drive device 4 in FIG. 1.

FIG. 2 is a front view of the drive device 4. The first cable 10 has a primary cable end portion 10*a* connecting to the slide door 1, while the second cable 11 has a primary cable end portion 11*a* connecting to the slide door 1. A base plate 5 of the drive device 4 is provided with a reversible motor 6, a gear box 7 and a main drum 30 which is rotatable around a shaft 8. Driving the reversible motor 6 causes a force for rotating, via a gear array in the gear box 7, the main drum 30 in a first rotational direction A1 and a second rotational direction A2. There is also provided a drum case, as is seen in FIG. 2.

An intermediate portion of the first cable 10 is guided by a first guide pulley 13*a* of a first cable guide 13 which is disposed on a forward given position of the body 2. Likewise, an intermediate portion of the second cable 11 is guide by a second guide pulley 14*a* of a second cable guide 14 which is disposed on a backward given position of the body 2.

The first cable 10 has a secondary cable end portion winding around an outer periphery of the main drum 30, while the second cable 11 has a secondary cable end portion winding around the outer periphery of the main drum 30.

Rotating the main drum 30 in the first rotational direction A1 can wind in the second cable 11 while winding out the first cable 10, thus moving the slide door 1 backward for opening. On the contrary, rotating the main drum 30 in the second rotational direction A2 can wind in the first cable 10 while winding out the second cable 11, thus moving the slide door 1 forward for closing.

Hereinabove, the drive device 4 is equipped with a clutch mechanism (not shown). Clutching and releasing the clutch mechanism (not shown) allows manual operation of the slide door 1 for opening and closing.

As is seen in FIG. 2, the base plate 5 is provided with a first tensioner 15 for applying a tensile force to the first cable 10 and a second tensioner 16 for applying the tensile force to the second cable 11.

Between an area defined by the first tensioner 15 and the first cable guide 13, the first cable 10 has a first outer tube 17. The first tensioner 15 biasing a first end portion 17*a* of the first outer tube 17 from an original position P0 (right in FIG. 2) to a first position P1 (right in FIG. 2) can apply the tensile force to the first cable 10. Moreover, the first tensioner 15 according to the embodiment is provided with a lock mechanism for locking the first end portion 17*a* to the original position P0 (right in FIG. 2), so as to prevent the tensile force from being applied to the first cable 10. Operating a first pawl 15*a* can unlock the lock mechanism, thus allowing a spring (not shown in FIG. 2) to bias the first end portion 17*a* to the first position P1 (right in FIG. 2), in other words, applying the tensile force to the first cable 10.

Likewise, between an area defined by the second tensioner 16 and the second cable guide 14, the second cable 11 has a second outer tube 18. The second tensioner 16 biasing a second end portion 18*a* of the second outer tube 18 from an original position P0 (left in FIG. 2) to a first position P1 (left in FIG. 2) can apply the tensile force to the second cable 11. Moreover, the second tensioner 16 according to the embodiment is provided with a lock mechanism for locking the second end portion 18*a* to the original position P0 (left in FIG. 2), so as to prevent the tensile force from being applied to the second cable 11. Operating a second pawl 16*a* can unlock the lock mechanism, thus allowing a spring (not shown in FIG. 2) to bias the second end portion 18*a* to the first position P1 (left in FIG. 2), in other words, applying the tensile force to the second cable 11.

Figure 3:
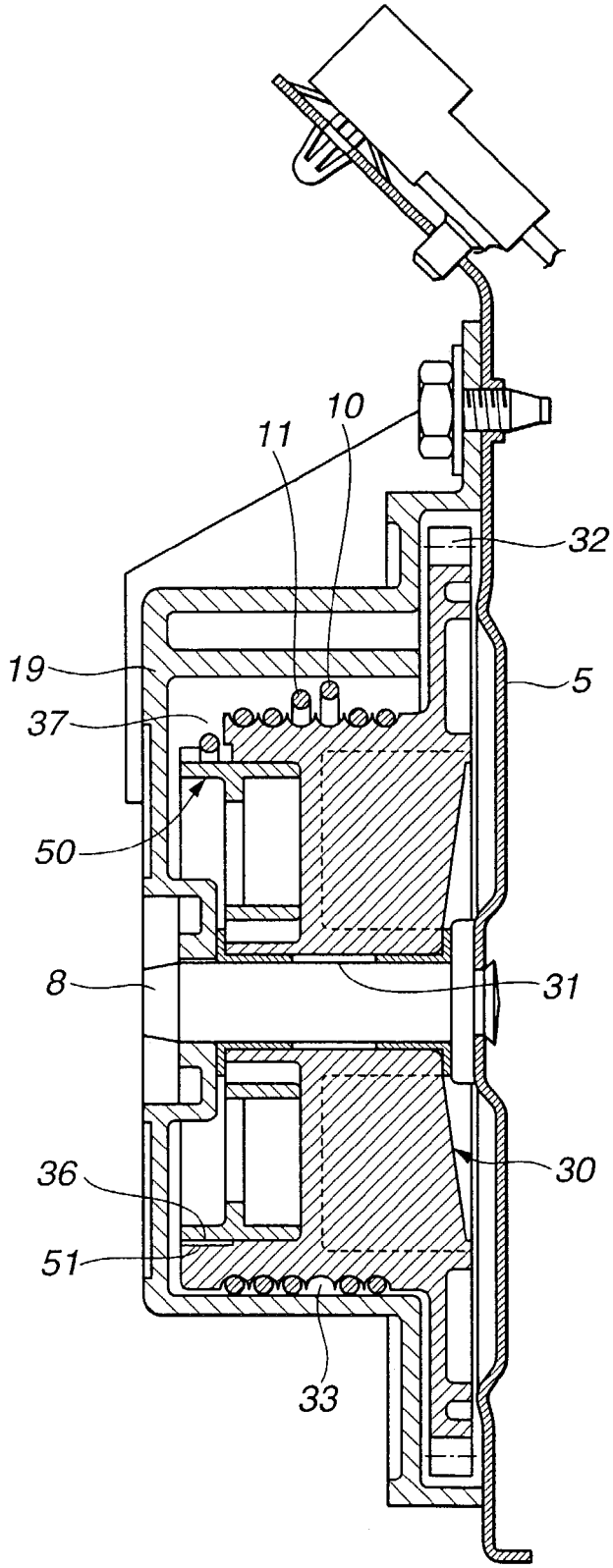
FIG. 3 shows a cross section taken along lines III—III in FIG. 2.

FIG. 3 shows a cross section taken along lines III—III in FIG. 2. Between the base plate 5 and a drum case 19 (mounted to the base plate 5), an adjuster drum 50 (otherwise referred to as "sub-drum 50") and the main drum 30 are received. The main drum 30 is rotatably supported with the shaft 8 which is implanted in the base plate 5.

Figure 4:
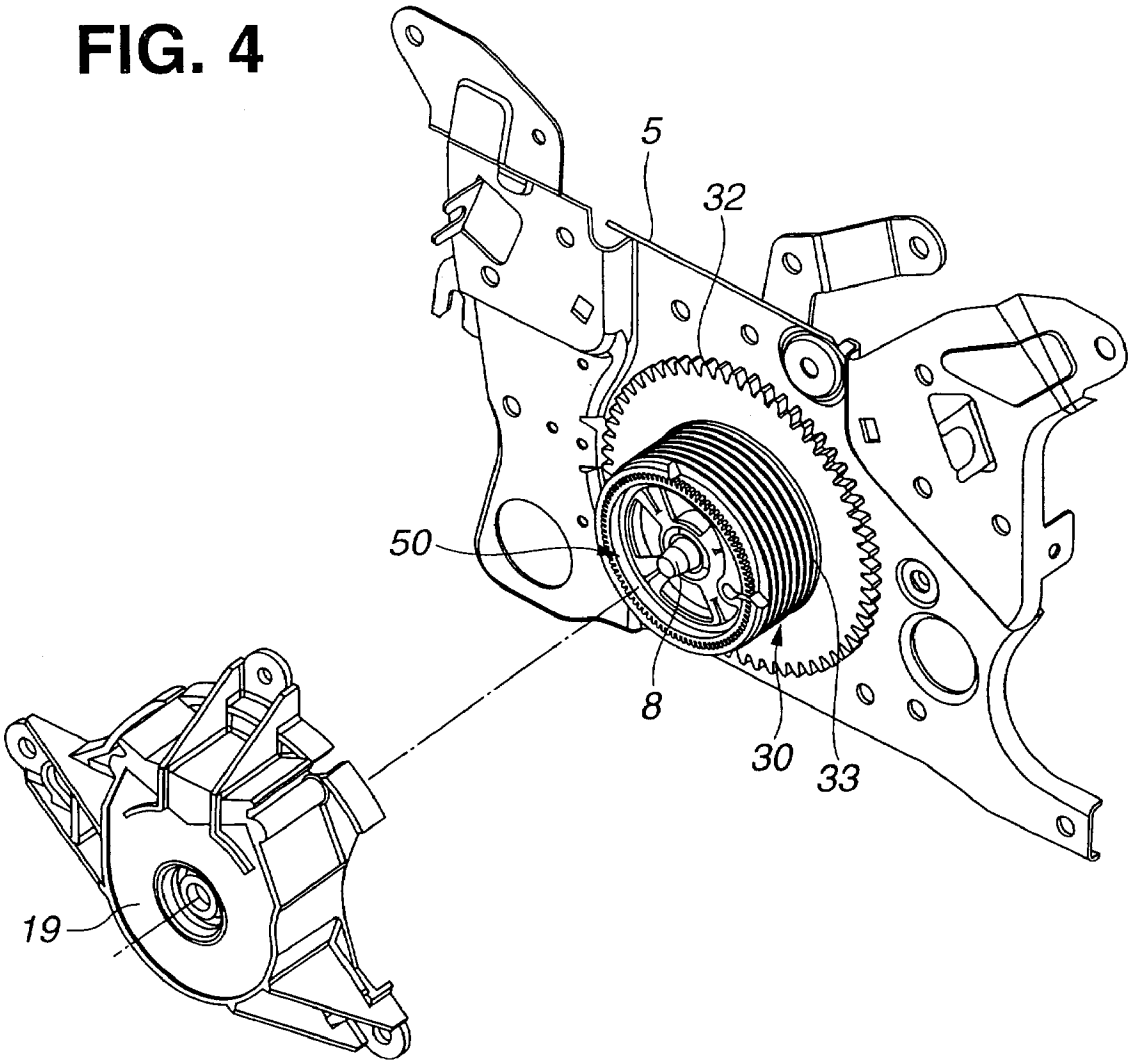
FIG. 4 is a broken perspective view of an essential part of the drive device 4 in FIG. 2.

FIG. 4 is a broken perspective view of an essential part of the drive device 4, with the drum case 19 dismantled from the base plate 5.

Figure 5:
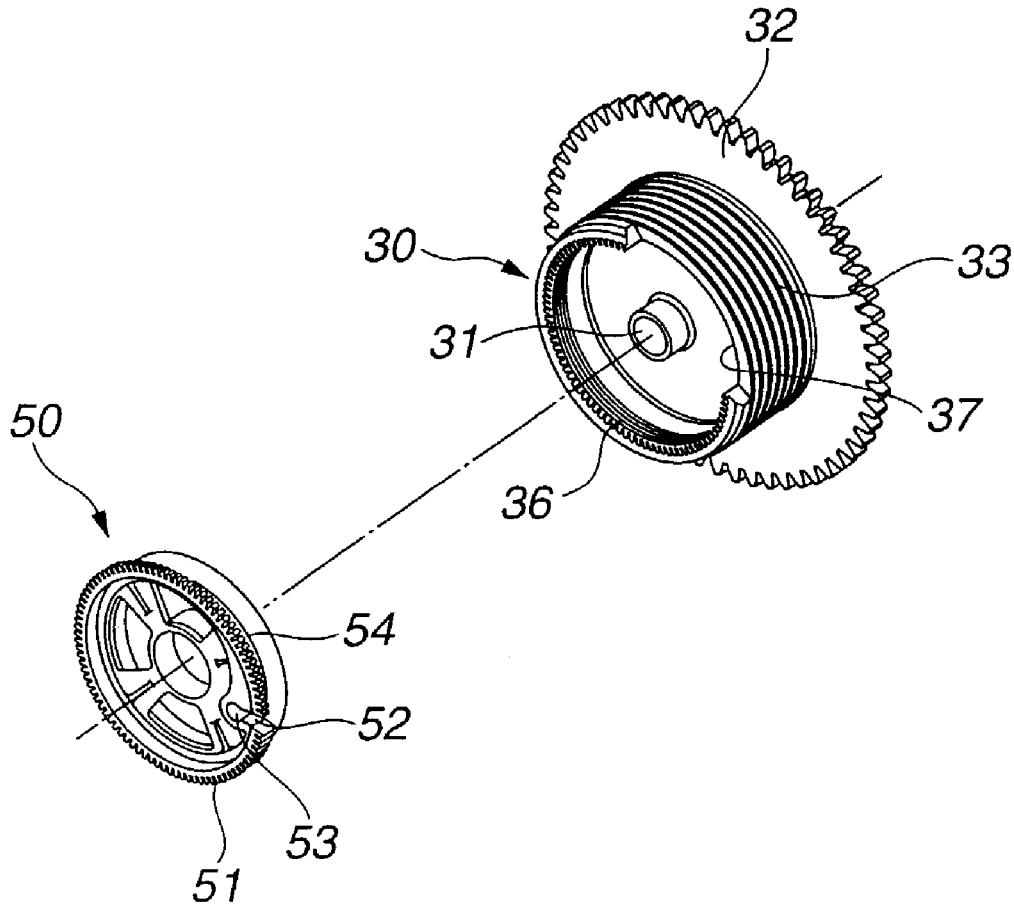
FIG. 5 is a broken perspective view of a main drum 30 and an adjuster drum 50 in FIG. 4.

FIG. 5 is a broken perspective view of the main drum 30 and the adjuster drum 50.

Figure 6:
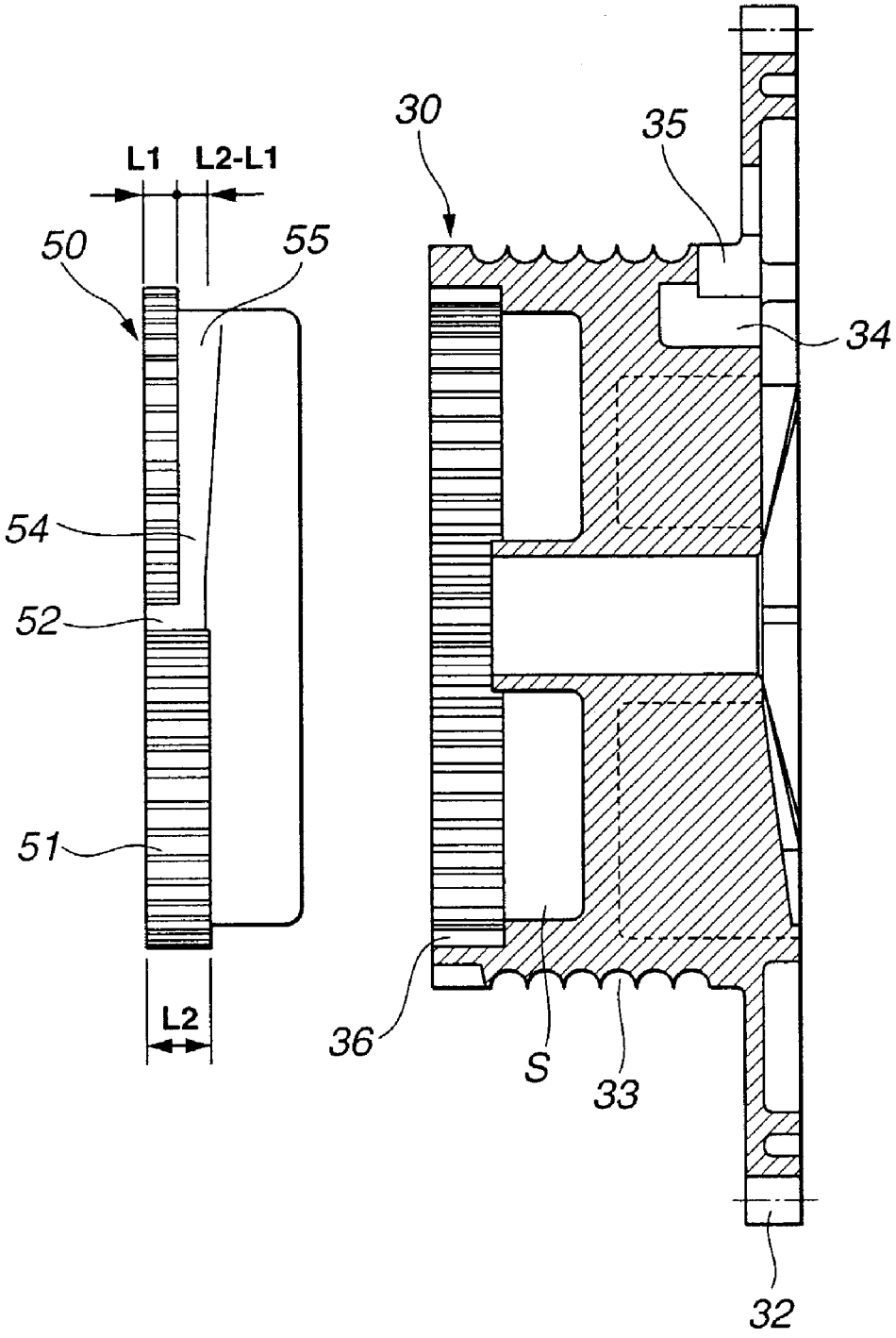
FIG. 6 is a broken side view of the main drum 30 and the adjuster drum 50, with the main drum 30 showing its cross section in FIG. 4.

FIG. 6 is a broken side view of the main drum 30 and the adjuster drum 50, with the main drum 30 showing its cross section.

Figure 8:
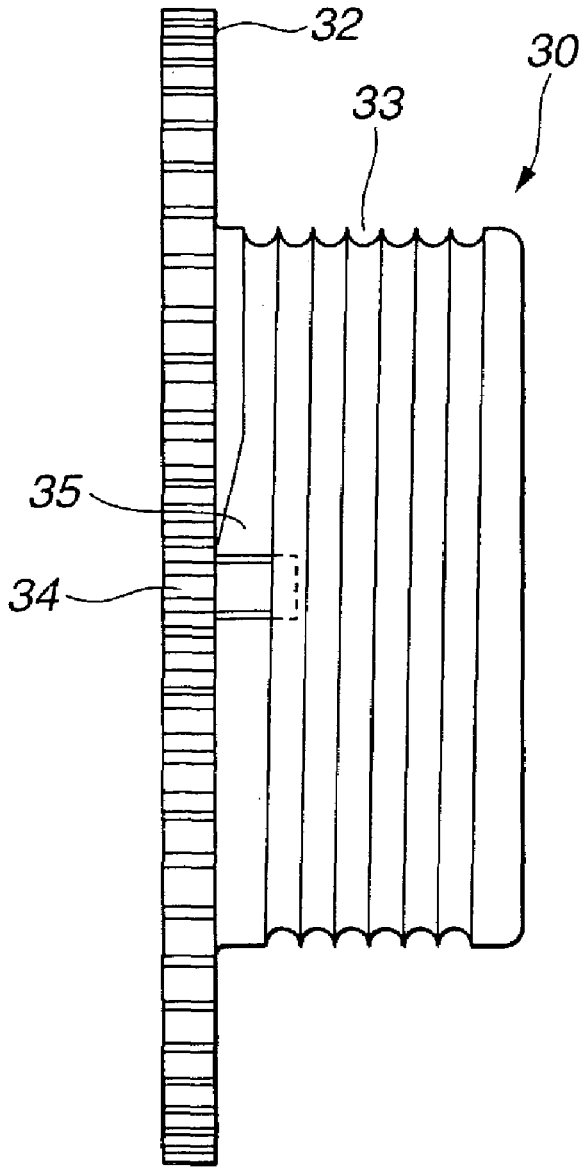
FIG. 8 shows the main drum 30 viewed in a direction VIII in FIG. 7.

Substantially in the center of the main drum 30, a through hole 31 is drilled for the shaft 8, as is best seen in FIG. 3. In FIG. 6, the main drum 30 has a right end formed with a gear 32 meshing with the gear array in the gear box 7 (see FIG. 2). For winding the first cable 10 and the second cable 11, the main drum 30 has the outer periphery formed with a spiral groove 33 (otherwise referred to as "winding portion 33") having a constitution of one start screw. On a right side of the main drum 30 in FIG. 6, there is formed a first mating groove 34 for mating with the secondary cable end portion (not shown) of the first cable 10. With an area in the vicinity of the secondary cable end portion (not shown) of the first cable 10 guided by a guide groove 35, the first cable 10 is led to a first side (right in FIG. 6, and left in FIG. 8) of the spiral groove 33. The thus led first cable 10 winds around the main drum 30 in such a manner as to be received in the spiral groove 33.

As is seen in FIG. 6, the main drum 30 has a left end having an inner periphery which is formed with an inner gear 36.

Figure 7:
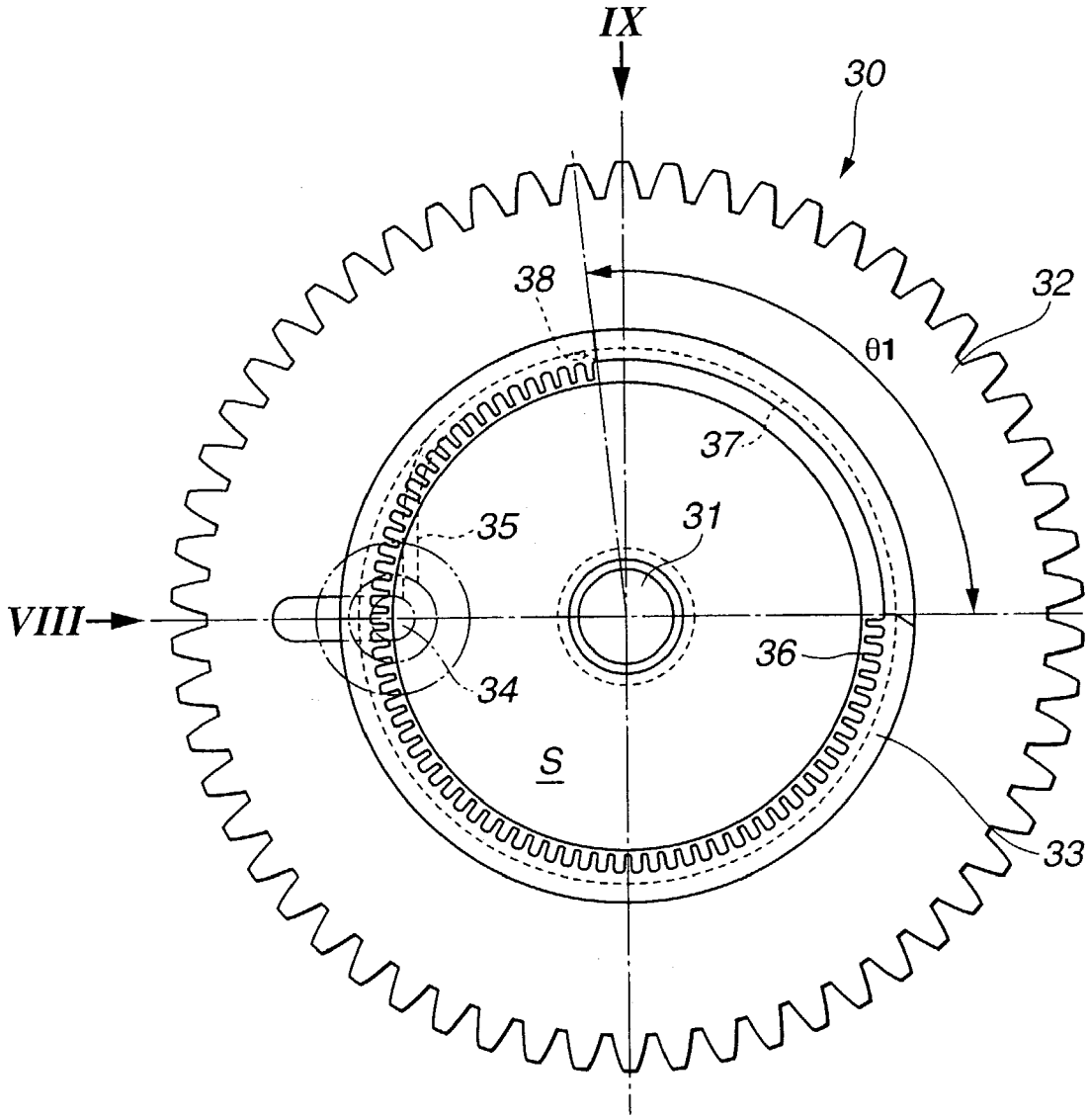
FIG. 7 is an enlarged front view of the main drum 30 in FIG. 4.

As is seen in FIG. 7, the inner gear 36 is partly cut out at a first angle θ1, thus forming a first cutout portion 37.

Figure 9:
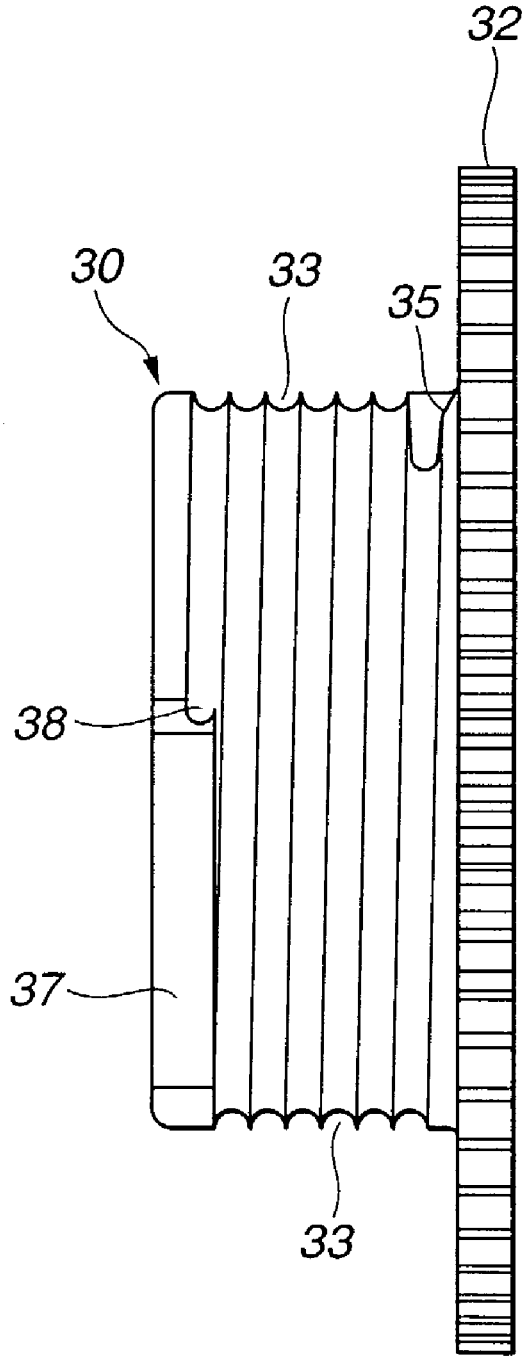
FIG. 9 shows the main drum 30 viewed in a direction IX in FIG. 7.

As is seen in FIG. 9, a second side (left in FIG. 9) of the spiral groove 33 continues into an inner space S (see FIG. 7) of the main drum 30 through a curved guide face 38 and the first cutout portion 37.

Figure 10:
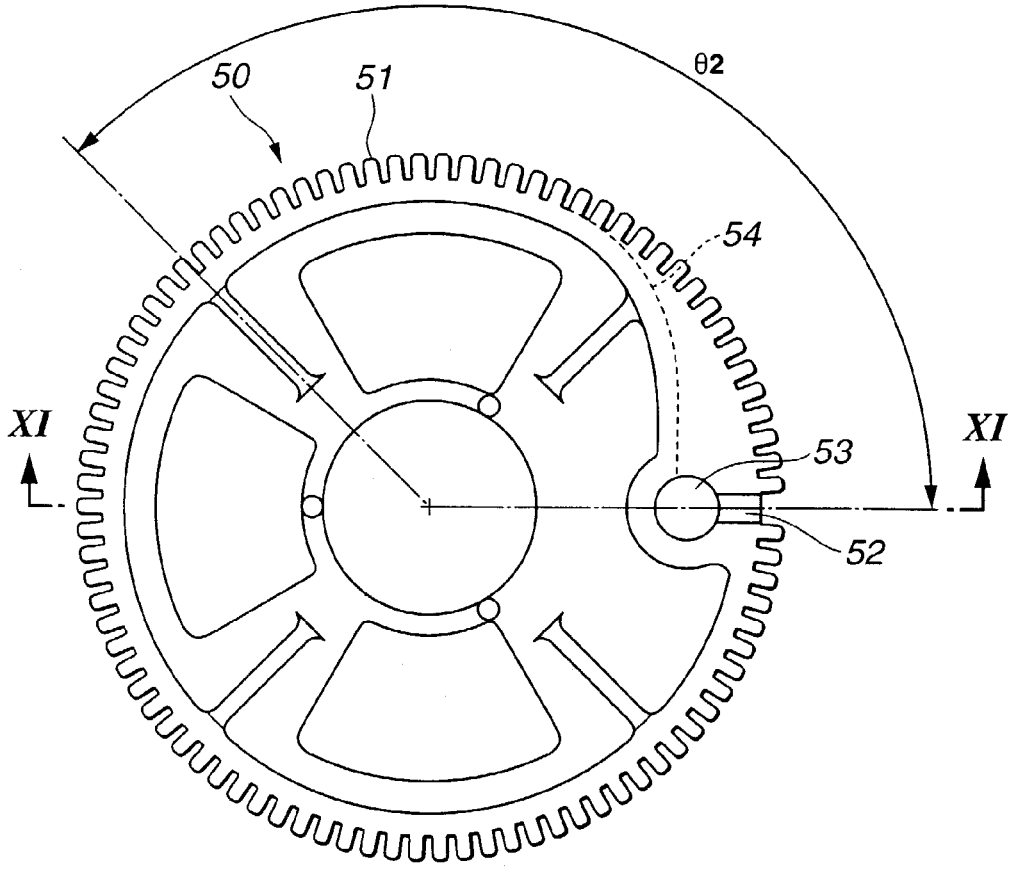
FIG. 10 is an enlarged front view of the adjuster drum 50 in FIG. 4.
Figure 11:
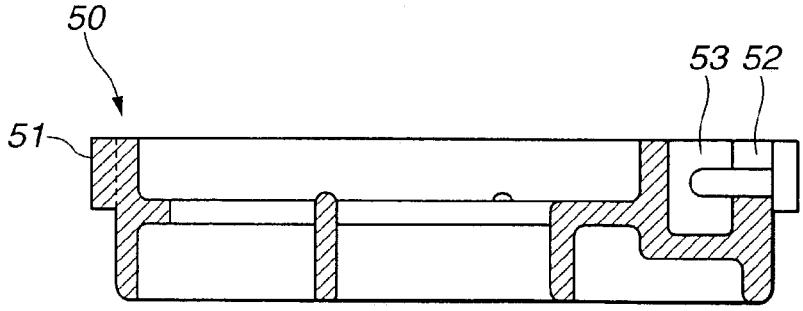
FIG. 11 shows a cross section taken along lines XI—XI in FIG. 10.

As is seen in FIG. 6, a left side of the adjuster drum 50 has an outer periphery formed with an outer gear 51 which can mesh with the inner gear 36 of the main drum 30. The outer gear 51 is partly cut out, thus forming a second cutout portion 52. Inside the second cutout portion 52, there is formed a second mating groove 53 for mating with the secondary cable end portion (not shown) of the second cable 11, as is seen in FIG. 10 and FIG. 11. As is seen in FIG. 6, the outer gear 51 has a first length L1 corresponding to a second angle θ2 in FIG. 10. Corresponding to an angular region other than the second angle θ2, the outer gear 51 has a second length L2 longer than the first length L1, as is seen in FIG. 6. With this, the outer gear 51 having the first length L1 on a left side thereof in FIG. 6 is, on a right side thereof, formed with a cable groove 55 for guiding the secondary cable end portion of the first cable 10. The cable groove 55 has a length L2–L1 obtained by subtracting the first length L1 from the second length L2, and extends in an area covered by the second angle θ2. The cable groove 55 is in series with the second mating groove 53 via a curved guide face 54. The guide face 54 is inclined toward the second mating groove 53, as is seen in FIG. 10.

Hereinafter described is a method of assembling the main drum 30 and the adjuster drum 50.

Mate the secondary cable end portion of the first cable 10 with the first mating groove 34 of the main drum 30. The secondary cable end portion of the first cable 10 is so guided by the guide groove 35 as to be led to the first side (right in FIG. 6, and left in FIG. 8) of the spiral groove 33. Thereby, the secondary cable end portion of the first cable 10 winds around the outer periphery of the main drum 30 in such a manner as to be received in the spiral groove 33. Hereinabove, the number of windings is to be given in advance.

On the other hand, mate the secondary cable end portion of the second cable 11 with the second mating groove 53 of the adjuster drum 50. Allow the guide face 54 to help lead the secondary cable end portion of the second cable 11, via the second cutout portion 52, outward around the adjuster drum 50 at the second angle θ2 in FIG. 10. Then, mate the adjuster drum 50 into the inner space S of the main drum 30 such that the outer gear 51 of the adjuster drum 50 can mesh with the inner gear 36 of the main drum 30, to thereby couple the adjuster drum 50 with the main drum 30. Then, the secondary cable end portion (which is led outward around the adjuster drum 50) of the second cable 11 is so guided by the guide face 38 as to be led to the second side (left in FIG. 9) of the spiral groove 33 via the first cutout portion 37 of the main drum 30. Thereby, the secondary cable end portion of the second cable 11 winds around the outer periphery of the main drum 30 in such a manner as to be received in the spiral groove 33. Hereinabove, the number of windings is to be given in advance.

A coupling position for coupling the adjuster drum 50 with the main drum 30 can be adjusted in an area that is at least partly shared by the first angle θ1 of the main drum 30 and the second angle θ2 of the adjuster drum 50. In accordance with the coupling position, the first cable 10 and the second cable 11 can be adjusted in length.

Coupling the adjuster drum 50 with the main drum 30 can be subjected to a visual inspection on a meshing position for meshing the inner gear 36 of the main drum 30 with the outer gear 51 of the adjuster drum 50, thus featuring good workability.

Moreover, meshing the inner gear 36 of the main drum 30 with the outer gear 51 of the adjuster drum 50 secures coupling of the adjuster drum 50 with the main drum 30.

Moreover, increasing the second angle θ2 of the cable groove 55 can secure a larger area for adjusting the coupling position for coupling the adjuster drum 50 with the main drum 30. In other words, with the increased second angle θ2 of the cable groove 55, the first cable 10 and the second cable 11 can be adjusted in length more extensively.

Forming the cable groove 55 substantially around an entire circumference of the adjuster drum 50 may further broaden the area for adjusting in length the first cable 10 and the second cable 11. Even in this constitution, the outer gear 51 can have the first length L1 in the area corresponding to the cable groove 55, thus securing sufficient strength for coupling the adjuster drum 50 with the main drum 30.

When adjusting in length the first cable 10 and the second cable 11, lock the first tensioner 15 (see FIG. 2) and the second tensioner 16 (see FIG. 2) respectively so as to prevent the tensile force from being applied to the first cable 10 and the second cable 11. After the adjustment in length of the first cable 10 and the second cable 11, the first tensioner 15 and the second tensioner 16 may apply the tensile force to the first cable 10 and the second cable 11 respectively, thus facilitating the adjustment of the first cable 10 and the second cable 11.

Obtaining proper adjustment in length of the first cable 10 and the second cable 11 can smoothen operation of opening and closing the slide door 1 in accordance with the first rotational direction A1 and the second rotational direction A2 of the main drum 30.

Although the present invention has been described above by reference to a certain embodiment, the present invention is not limited to the embodiment described above. Modifications and variations of the embodiment described above will occur to those skilled in the art, in light of the above teachings.

More specifically, according to the embodiment of the present invention described above, it is the main drum 30 that has the inner gear 36 while it is the adjuster gear 50 that has the outer gear 51. The present invention is, however, not limited to this. The main drum 30 can have an outer gear while the adjuster gear 50 can have an inner gear.

Moreover, according to the embodiment of the present invention, the drive device 4 is applied to the slide door 1 of the vehicle. The present invention, is however, not limited to this. The drive device 4 is also applicable to other types of slide bodies including those for a window regulator and the like.

This application is based on a prior Japanese Patent Application No. P2002-137768 (filed on May 13, 2002 in Japan). The entire contents of the Japanese Patent Application No. P2002-137768 from which priority is claimed is incorporated herein by reference, in order to take some protection against mis-translation or omitted portions.

The scope of the present invention is defined with reference to the following claims.

What is claimed is:

1. A drive device for opening and closing a slide body, the drive device comprising:

I) a first cable having a primary cable end portion adapted for connection to said slide body and a second cable end portion opposite to the primary cable end portion of the first cable, the first cable having a cable length;

II) a second cable having a primary cable end portion adapted for connection to the slide body and a second cable end portion opposite to the primary cable end portion of the second cable, the second cable having a cable length; and III) a drum mating with the second cable end portion of the first cable and mating with the second cable end portion of the second cable, the drum being adapted to rotate in a first rotational direction for winding in one of the first cable and the second cable while winding out the other of the first cable and the second cable, thus opening the slide body, the drum being adapted to rotate in a second rotational direction opposite to the first rotational direction for winding in the other of the first cable and the second cable while winding out the one of the first cable and the second cable, thus closing the slide body, the drum comprising;

i) a main drum mating with the second cable end portion of the first cable and being rotatable, the main drum having an inner face and an outer face, and ii) a sub-drum mating with the second cable end portion of the second cable and being rotatable substantially coaxially with the main drum around a shaft, the sub-drum having an inner face and an outer face, an inner gear being formed with radially extended teeth on the inner face of one of the main drum and the sub-drum, an outer gear being formed with radially extended teeth on the outer face of the other of the main drum and the sub-drum, the inner gear meshing with the outer gear for adjusting the cable length of the first cable and the cable length of the second cable, wherein the main drum has an outer periphery formed with a winding portion for winding the first cable and the second cable, the main drum is formed with a first cutout portion for leading the second cable end portion of the second cable to the winding portion, and the sub-drum is formed with a second cutout portion for leading the second cable end portion of the second cable to the winding portion.

2. The drive device for opening and closing the slide body as claimed in claim 1, wherein the sub-drum has an outer periphery formed with a cable groove for guiding the second cable end portion of the second cable disposed between the second cutout portion and the winding portion.

3. A drive device for opening and closing a slide body, the drive device comprising:

I) a first cable having a primary cable end portion adapted for connection to said slide body and a second cable end portion opposite to the primary cable end portion of the first cable, the first cable having a cable length;

II) a second cable having a primary cable end portion adapted for connection to the slide body and a second cable end portion opposite to the primary cable end portion of the second cable, the second cable having a cable length; and III) a drum mating with the second cable end portion of the first cable and mating with the second cable end portion of the second cable, the drum being adapted to rotate in a first rotational direction for winding in one of the first cable and the second cable while winding out the other of the first cable and the second cable, thus opening the slide body, the drum being adapted to rotate in a second rotational direction opposite to the first rotational direction for winding in the other of the first cable and the second cable while winding out the one of the first cable and the second cable, thus closing the slide body, the drum comprising;

i) a main drum mating with the second cable end portion of the first cable and being rotatable, the main drum having an inner face and an outer face, and ii) a sub-drum mating with the second cable end portion of the second cable and being rotatable substantially coaxially with the main drum around a shaft, the sub-drum having an inner face and an outer face, an inner gear being formed with radially extended teeth on the inner face of the main drum, an outer gear being formed with radially extended teeth on the outer face of the sub-drum, the inner gear meshing with the outer pear for adjusting the cable length of the first cable and the cable length of the second cable, wherein substantially in a center of the main drum, a through hole is drilled for the shaft, the main drum has a first end formed with a gear meshing with a gear array in a gear box, the main drum has an outer periphery formed with a winding portion comprising a spiral groove having a start screw, the main drum has a first mating groove formed for mating with the second cable end portion of the first cable, the main drum has a guide groove for leading the first cable is to the spiral groove, and the thus led first cable winds around the main drum in such a manner as to be received in the spiral groove.

4. A drive device for opening and closing a slide body, the drive device comprising:

I) a first cable having a primary cable end portion adapted for connection to said slide body and a second cable end portion opposite to the primary cable end portion of the first cable, the first cable having a cable length;

II) a second cable having a primary cable end portion adapted for connection to the slide body and a second cable end portion opposite to the primary cable end portion of the second cable, the second cable having a cable length; and III) a drum mating with the second cable end portion of the first cable and mating with the second cable end portion of the second cable, the drum being adapted to rotate in a first rotational direction for winding in one of the first cable and the second cable while winding out the other of the first cable and the second cable, thus opening the slide body, the drum being adapted to rotate in a second rotational direction opposite to the first rotational direction for winding in the other of the first cable and the second cable while winding out the one of the first cable and the second cable, thus closing the slide body, the drum comprising;

i) a main drum mating with the second cable end portion of the first cable and being rotatable, the main drum having an inner face and an outer face, and ii) a sub-drum mating with the second cable end portion of the second cable and being rotatable substantially coaxially with the main drum around a shaft, the sub-drum having an inner face and an outer face, an inner gear being formed with radially extended teeth on the inner face of the main drum, an outer gear being formed with radially extended teeth on the outer face of the sub-drum, the inner gear meshing with the outer gear for adjusting the cable length of the first cable and the cable length of the second cable, wherein substantially in a center of the main drum, a through hole is drilled for the shaft, the main drum has a first end formed with a gear meshing with a gear array in a gear box, the main drum has an outer periphery formed with a winding portion comprising a spiral groove having a start screw, the main drum has, a first mating groove for mating with the second cable end portion of the first cable, the main drum has a guide groove for leading, the first cable is to the spiral groove, and the thus led first cable winds around the main drum in such a manner as to be received in the spiral groove, and wherein the inner gear is partly cut out in an arc defined by a first angle, thus forming a first cutout portion.

5. The drive device for opening and closing the slide body as claimed in claim 4, wherein the spiral groove continues into an inner space of the main drum through a curved guide face and the first cutout portion.

6. The drive device for opening and closing the slide body as claimed in claim 5, wherein the outer gear is partly cut out, thus forming a second cutout portion, the outer clear includes a second mating groove for mating with the second cable end portion of the second cable.

7. The drive device for opening and closing the slide body as claimed in claim 6, wherein the second cable end portion of the first cable is mated with the first mating groove of the main drum in such a manner that the second cable end portion of the first cable is guided by the guide groove as to be led to the spiral groove.

8. The drive device for opening and closing the slide body as claimed in claim 7, wherein the second cable end portion of the second cable is so mated with the second mating groove as to allow a guide face of the sub-drum to help lead the second cable end portion of the second cable, via the second cutout portion, outward around the sub-drum, the sub-drum is mated into the inner space of the main drum such that the outer gear of the sub-drum meshes with the inner gear of the main drum, to thereby couple the sub-drum with the main drum, the second cable end portion of the second cable is so guided by the guide face as to be led to the spiral groove via the first cutout portion of the inner pear, and the second cable end portion of the second cable, thereby, winds around the outer periphery of the main drum in such a manner as to be received in the spiral groove.

9. The drive device for opening and closing the slide body as claimed in claim 8, wherein a coupling position for coupling the sub-drum with the main drum is adjusted to adjust the lengths of the first and second cables.

* * * * *